US005911410A

United States Patent [19]

Wullimann

[11] Patent Number: 5,911,410

[45] Date of Patent: Jun. 15, 1999

[54] HOISTING AND LOWERING APPARATUS

[75] Inventor: Frank Wullimann, Bettlach, Switzerland

[73] Assignee: Rollgliss AG, Switzerland

[21] Appl. No.: 08/750,251

[22] PCT Filed: Dec. 4, 1995

[86] PCT No.: PCT/CH95/00287

§ 371 Date: Dec. 5, 1996

§ 102(e) Date: Dec. 5, 1996

[87] PCT Pub. No.: WO97/17107

PCT Pub. Date: May 15, 1997

[30] Foreign Application Priority Data

Nov. 6, 1995 [CH] Switzerland ..... 3134/95
Nov. 7, 1995 [CH] Switzerland ..... 3148/95

[51] Int. Cl.[6] ..... B66D 1/28

[52] U.S. Cl. ..... 254/334; 254/266; 254/399

[58] Field of Search ..... 234/337, 338, 234/334, 335, 336, 399, 266

[56] References Cited

U.S. PATENT DOCUMENTS

| | | | |
|---|---|---|---|
| 840,676 | 1/1907 | Winnard et al. | 254/399 |
| 2,463,394 | 3/1949 | King | 254/337 |
| 4,084,794 | 4/1978 | Wallace | 254/399 |
| 4,098,492 | 7/1978 | Wilkinson | 254/399 |
| 4,721,286 | 1/1988 | Hey et al. | 254/399 |
| 4,850,571 | 7/1989 | Cabanos | 254/399 |

FOREIGN PATENT DOCUMENTS

| | | |
|---|---|---|
| 526 308 | 12/1971 | Switzerland . |
| 541 975 | 2/1973 | Switzerland . |
| WO 94/04223 | 3/1994 | WIPO . |

*Primary Examiner*—Katherine Matecki
*Attorney, Agent, or Firm*—McDermott, Will & Emery

[57] ABSTRACT

In order to increase the operational safety and to reduce the rope wear, hoisting/lowering apparatus comprise one or a combination of novel features: an adaptor (3) is provided in order to allow the attachment of accessories (50), preferably by insertion. Possible accessories are e.g. holders having a loop for the attachment of hooks, and single or multiple blocks for the formation of lifting blocks. Substantially, the adaptor is formed of a number of slot-shaped recesses which are transversely traversed by rod-shaped retaining elements (11, 9). One of said retaining elements (9) is displaceably mounted in order to allow the attachment resp. detachment of an accessory (50). Another measure is to provide a rope stop (102) on the traction side. The rope (103) runs through the rope stop (102) and drives a knurled wheel (110). At a given rope speed, the wheel is coupled to a pivotable brake appendix (118) by means of a centrifugal coupling (113, 115). The rope (103) is then squeezed and blocked between the appendix (118) and a counterpart (108). A third measure consists in providing guiding rolls (36, 37) in order to ensure a spiral-shaped travel of the rope (103) which is free of crossings.

13 Claims, 11 Drawing Sheets

HOISTING AND LOWERING APPARATUS

FIELD OF THE INVENTION

The present invention refers to a hoisting and lowering apparatus.

BACKGROUND OF THE INVENTION

A hoisting and lowering apparatus, e.g. according to European patent publication EP-A-0 480 117 of the applicant, are preferentially used for the purpose of raising or lowering persons or loads on a rope. Preferred fields of application are rescue operations or generally the mobile application of such apparatus. Essentially, the hoisting/lowering apparatus have the function of reducing the retention force in the lowering operation, combined with a safety against an uncontrolled fall of the person or load suspended on the rope.

It has been found that the known hoisting/lowering apparatus should be variably equipped according to the actual conditions of application. For example, it should be possible with the hoisting/lowering apparatus to form a lifting block, or a possibility for the attachment of a spring hook etc. is required. However, in known hoisting/lowering apparatus, some of these different options have mutually excluded each other or, if designed for maximum functionality, they have led to an unconveniently large and heavy appliance.

Also, as the case may be, the use of a hoisting/lowering apparatus which is not adapted to the actual conditions of application can lead to an overload of the rope as well as to safety risks due to a possible overload of the safety devices of the hoisting/lowering apparatus. The consequences are the need for a premature replacement of the rope and the risk of rupture of the rope and of malfunctions of the appliance.

Usually, these known hoisting/lowering apparatus include a large-volume pulley having a large volume which is provided with a return stop. In most cases, a rope is wrapped 2½ times around said pulley. In operation, the pulley is running freely during hoisting and offers little resistance. In descending, however, the pulley is blocked by the return stop, and the rope slides over the surface of the pulley. The resulting friction takes up the greater part of the load suspended on the rope.

Furthermore, an emergency stop for the rope is often provided on the load the of the pulley. Essentially, said rope stop senses the running speed of the rope particularly in the descending direction. In the case of an excessive speed, the rope stop is released and directly blocks the rope.

However, in practice, the known hoisting/lowering apparatus of this type cause a considerable wear of the rope by overcrossing windings on the pulley, in the passage of the known emergency stop, and especially when the latter is released. This wear reduces the resistance of the rope and the action of the emergency stop may cause a rupture of the rope, and the function of the hoisting/lowering apparatus is impaired since the frictional resistance on the pulley is altered.

SUMMARY OF THE INVENTION

It is an object of the present invention to reduce the wear of the rope in a hoisting/lowering apparatus.

Another object of the present invention is to provide a device allowing a hoisting/lowering apparatus to be adapted to a large number of different requirements in use.

Such devices as attain at least one of the cited objects are indicated in the independent claims. The further claims define preferred embodiments of the device of the invention.

Accordingly, one aspect of the invention is to provide a hoisting/lowering apparatus which essentially corresponds to the state of the art, with an adaptor for the attachment of different accessories such as a holder having a loop for the insertion of a spring hook or different pulley assemblies for the formation of a lifting block. The adaptor is preferably designed as a self-locking plug-in coupling, so that the attachment of accessories is obtained simply by insertion.

The wear of the rope in a hoisting/lowering apparatus can also be reduced by placing the rope stop on the traction side. In this case, however, on account of the lower tension of the rope on the traction side, especially when the latter slips from the hold of the operator, a rope stop is preferred which is provided with a better rope guiding and a rope speed sensor whose action is lighter and nevertheless as precise as possible, i.e. which is activated by as small a deviation of the predetermined allowable rope speed as possible.

Finally, it is also important to ensure a uniform rope guidance on the pulley by means of rope guiding devices since the frictional resistance also depends on the rope travel, and more particularly, to prevent any crossing of the rope on the pulley whereby the rope would be exposed to an increased local wear.

DESCRIPTION OF THE DRAWINGS

The invention shall be further explained by way of an exemplary embodiment with reference to the figures.

DETAILED DESCRIPTION OF A PRESENTLY PREFERRED EMBODIMENT

Figure 1:
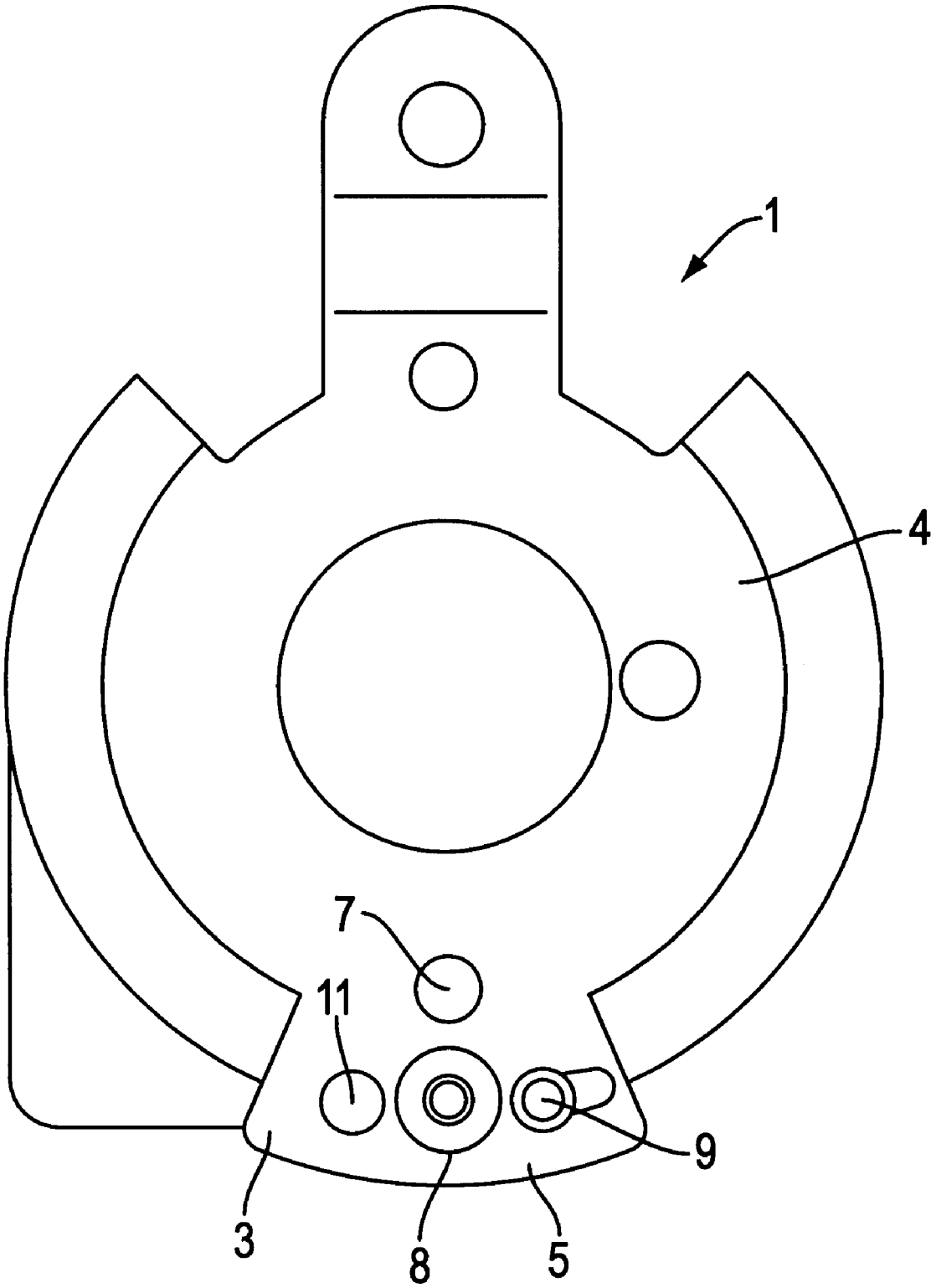
FIG. 1 shows a lateral view of a hoisting/lowering apparatus according to the invention with an adaptor.
Figure 2:
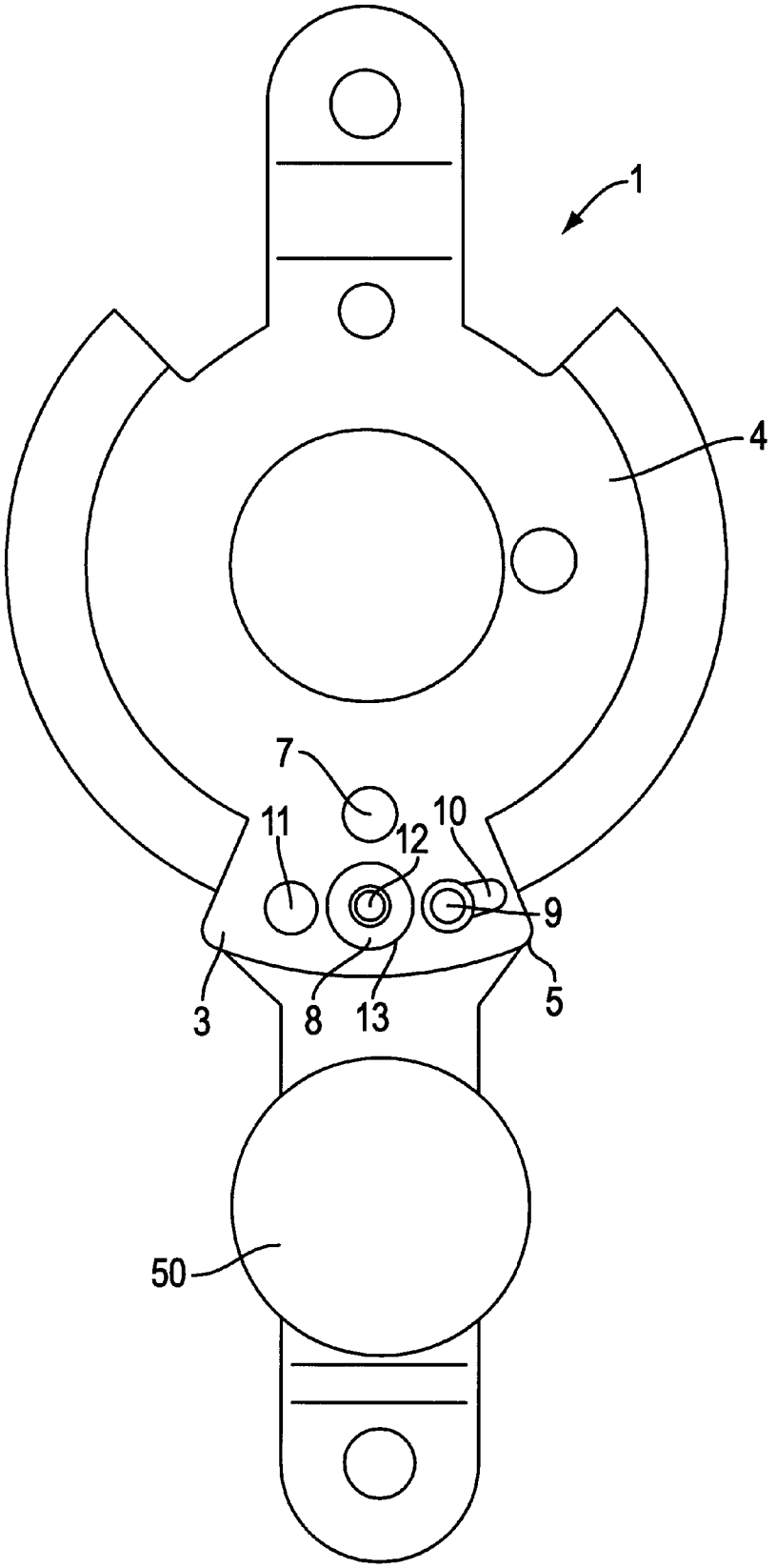
FIG. 2 shows the same with an attached accessory.
Figure 3:
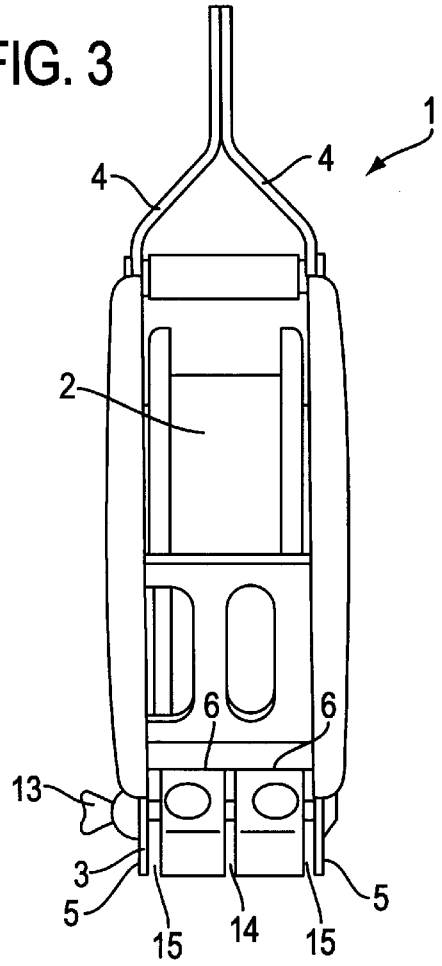
FIG. 3 shows a lateral view of the hoisting/lowering apparatus of FIG. 1.

The hoisting/lowering apparatus of FIGS. 1 to 3 essentially consists of the known, large-volume pulley 2 which is provided with a return stop. Such hoisting/lowering apparatus are known, e.g. from the abovementioned patent application EP-A-0 480 117.

According to the invention, an adaptor 3 is provided at the lower end of the hoisting/lowering apparatus. For this purpose, side plates 4 have sector-shaped prolongations 5 between which a block 6 (FIG. 3) is disposed. Block 6 is fastened between the two side plates 4 by means of two stationary bolts 7, 11. The contour of block 6 corresponds to prolongations 5, so that it is covered by the latter. Besides the bores for bolts 7, block 6 and prolongations 5 have additional bores for a safety pin 8 and for displaceable retention bolt 9, the bore for the latter being an oblong hole. By a non-represented spring element, retention bolt 9 in its home position or retaining position is pressed against the end of oblong hole 10 which is nearer to fixed retention bolt 11. As spring elements, pressure springs may be disposed in bores of block 6, for example.

Safety pin 8, whose stability corresponds to that of retention bolts 9, 11, can be withdrawn after pressing release 12. Release 12 is countersunk in a surrounding collar 13, so that release 12 can only be actuated by an explicit pressure of he finger or the like, but not by the impact of a larger object, for example. The locking mechanism of safety pin 12 opens against the pressure of a spring, in such a manner that safety pin 8 is simply inserted in its bore in adaptor 3 and is automatically locked therein as soon as it is completely inserted to the stop. Such safety pins are known, and a detailed description is therefore omitted.

As shown in FIG. 3, block 6 further includes a central groove 14 which, together with the two slots 15 formed between block 6 and the respective side plate 5, results in a total of three fastening points on adaptor 3.

Figure 4:
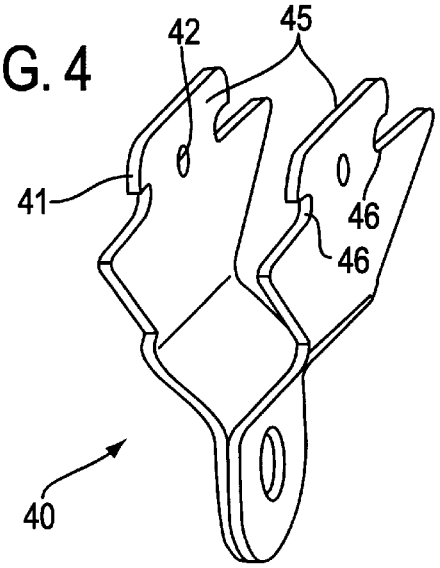
FIG. 4 shows a holder having a loop.
Figure 5:
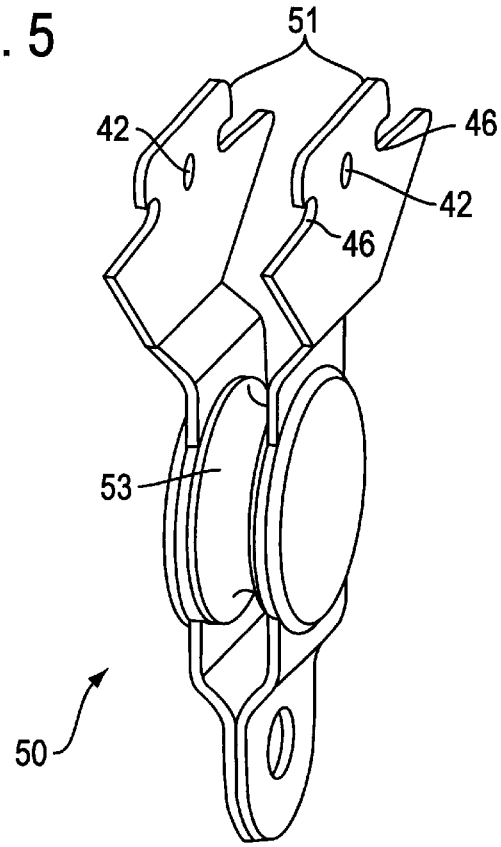
FIG. 5 shows an accessory having a pulley.
Figure 6:
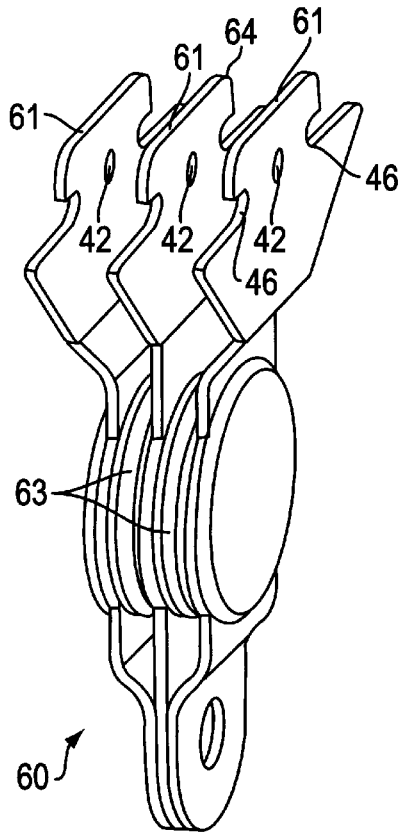
FIG. 6 shows an accessory having a double pulley and a triple coupling.

FIGS. 4, 5 and 6 show preferred accessories, namely a holder 40 for the purpose of securing a hook or the like, a single pulley block 50 and a double block 60, respectively, the latter for the purpose of forming a corresponding lifting block.

In order to attach an accessory, the safety pin 8 is first removed. Then, the movable retaining bolt 9 is moved to the other end of the oblong hole 10 against the spring force, the concerned accessory is obliquely introduced in the adaptor 3, and one of its recesses 46 is engaged in the fixed retaining pin 11. The accessory 40, 50, or 60 is then swung around the retaining bolt 11 and thus approached to the adaptor 3, and the movable retaining bolt 9 is released, whereby it is returned to its retaining position while sliding into the other recess 46. Meanwhile, the accessory is already safely fastened to the hoisting/lowering apparatus. Now, in addition, the safety pin 8 is stuck through the adaptor 3 and at the same time through the corresponding bores 42, 52 or 62 in FIGS. 4, 5 and 6 respectively. The safety against an involuntary detachment of the accessories, which is often compulsorily required for safety reasons, is thus realized.

Preferably, all accessories comprise at least two couplings 41, 51 or 61 in FIGS. 4, 5 and 6 respectively as side plates 4 constitute the main supporting elements of hoisting/lowering apparatus 1 and a coupling by engagement in lateral slots 15 transmits the force from accessories 40, 50, 60 directly to the side plates. Accessory 60, which has two independent pulleys 63 and is suitable for the formation of a multiple lifting block for large weights, is provided with a triple coupling for reasons of stability, the central coupling element 64 being engaged in the center slot 14. Two of the couplings, 51 and 41 respectively, which are intended to be introduced in the lateral slots 15, are sufficient for accessory 50 which has a single pulley 53, and for the simplest embodiment of the accessory 40 which has only one point of attachment 43 for a hook.

The couplings 41 essentially comprise a tongue whose width increases on both sides, whereby two opposing U-shaped recesses 46 are formed which are essentially disposed at the same height, or in other words, a neck. The fixed and displaceable retaining bolts, 11 and 9 respectively, engage in these two recesses 46 of each coupling. The bore 42 for the safety pin 8 is disposed between the two recesses 46 of each coupling 41. The U-shaped recesses 46 as the well as bores 42 of the couplings of an accessory are aligned to each other. The corners at the free ends of the tongues 46 are preferably rounded or tapered. The movable retaining bolt is thereby pushed to its releasing position as far as necessary by sliding over said oblique surfaces.

The construction of the couplings 51 and 61 of accessories 50 and 60 is essentially identical.

Figure 7:
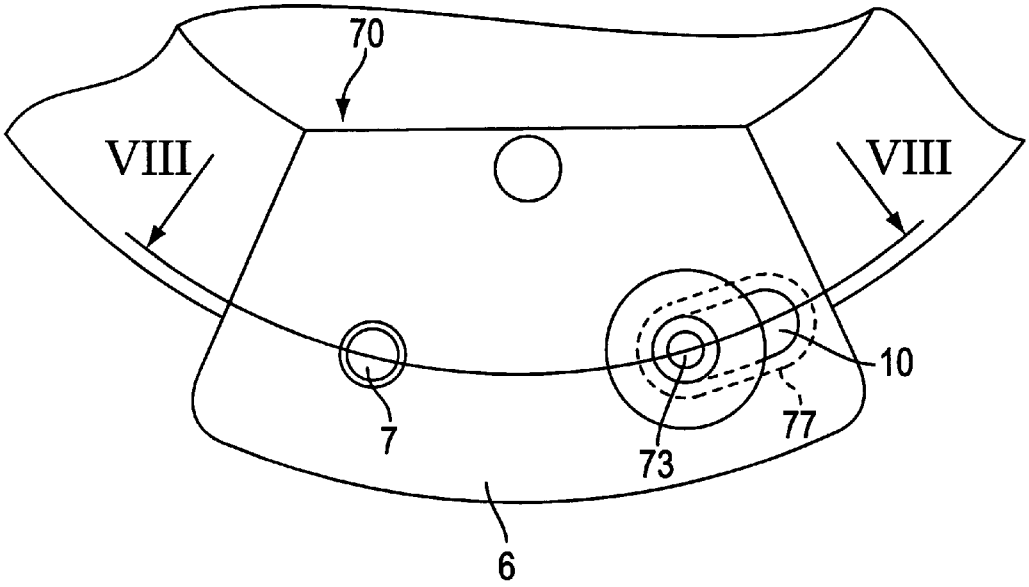
FIG. 7 shows a plan view of a preferred embodiment of the adaptor.
Figure 8:
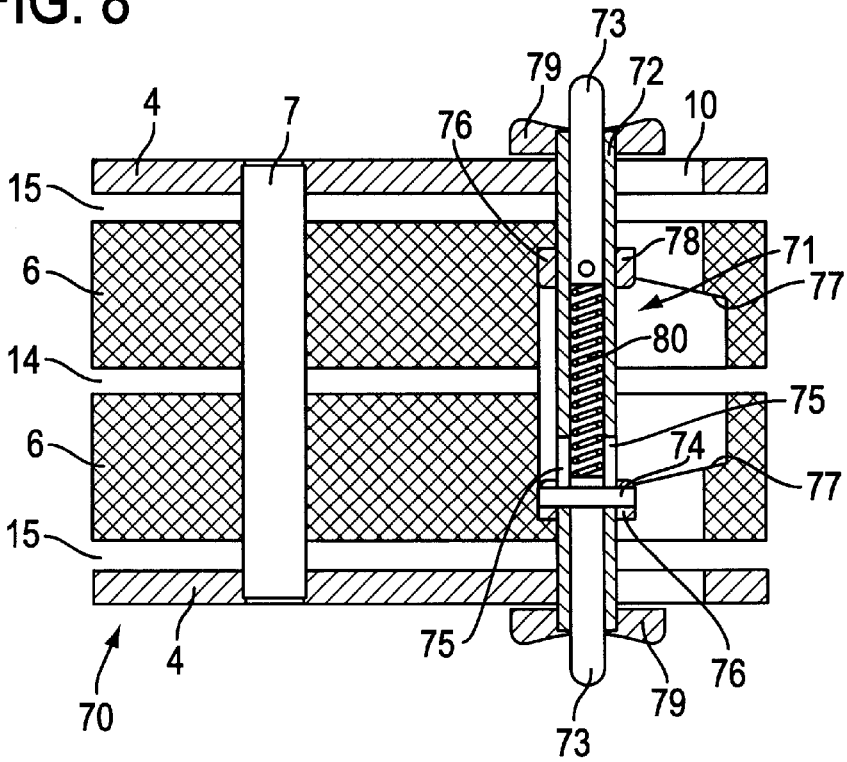
FIG. 8 shows a cross-section through the section line VIII—VIII in FIG. 7.

Further, FIGS. 7 and 8 show a preferred embodiment 70 of the adaptor in more detail. The essential difference is that the functions of displaceable retaining bolt 9 and that of safety pin 8 are united. The remaining construction features correspond to those of FIGS. 1 to 3 and carry the same reference numerals. Essentially, displaceable bolt 71 is composed of a sleeve 72 in which two pins 73 are slidably guided. At their inner end, each of them is traversed by a transversal pin 74 which in turn passes through an oblong bore 75 on both sides and is anchored in a bushing 76 by its ends which project from sleeve 72. Bushings 76 are displaceable on sleeve 72. The two walls of the central groove are provided with a recess 77 extending around oblong holes 10. The depth of said recess increases towards those ends of oblong holes 10 which correspond to the retaining position of displaceable retaining bolt 71. An additional cavity having a marked step 78 is as exactly adjusted to the dimensions of bushings 76 as possible, in such a manner that the latter fit into this additional cavity with little play and a self-acting departure of retaining bolt 71 from its retaining position is prevented. Between the two pins 73, a pressure spring is provided which, in conjunction with the inclined bottom of recess 77, facilitates the sliding return of retaining bolt 71 to its locked position, on one hand, and also engages bushings 76 positively in the additional cavities in the retaining position.

Furthermore, both ends of the sleeve 72 are provided with a respective collar 79. The collars 79 act as two-sided guidings for sleeve 72. In this embodiment, in contrast to the embodiment of FIGS. 1 to 3, the collars are so flat that the pins 73 can be pushed in by a flat object. In the case of increased safety requirements, the collar 79 may have such a height that this is no longer possible. On the other hand, the impact of an object on only one side just releases the retaining bolt on one side, while bushing 76 on the other side still maintains the retaining bolt 1 in the locked position. As soon as the object is the unlocked bushing 76 will automatically slide back into the additional cavity behind the step 78, whereby the retaining bolt 71 is again completely locked.

Modifications of the described example are accessible to those skilled in the art without leaving departing from the scope of the invention.

More particularly, it is possible to provide any number of fastening points 14, 15 other than three. Instead of the indicated accessories, different ones may be used, provided that they dispose of a coupling which is adapted to the adaptor.

The oblong hole 10 may also be designed to be outwardly rising, so that a tension on an attached accessory will contribute to pushing the displaceable retaining bolt into its retaining position. Consequently, it is also possible to omit the spring elements which push the displaceable retaining bolt into its retaining position or to make them relatively weak.

FIGS. 9 to 15 show devices according to the invention which are particularly intended to increase operational safety by a reduction in rope strain in the hoisting/lowering apparatus itself. Although they attain at least one of the objects of the invention individually, their combination and/or their association with the adaptor described above results in a further improved effect.

Figure 9:
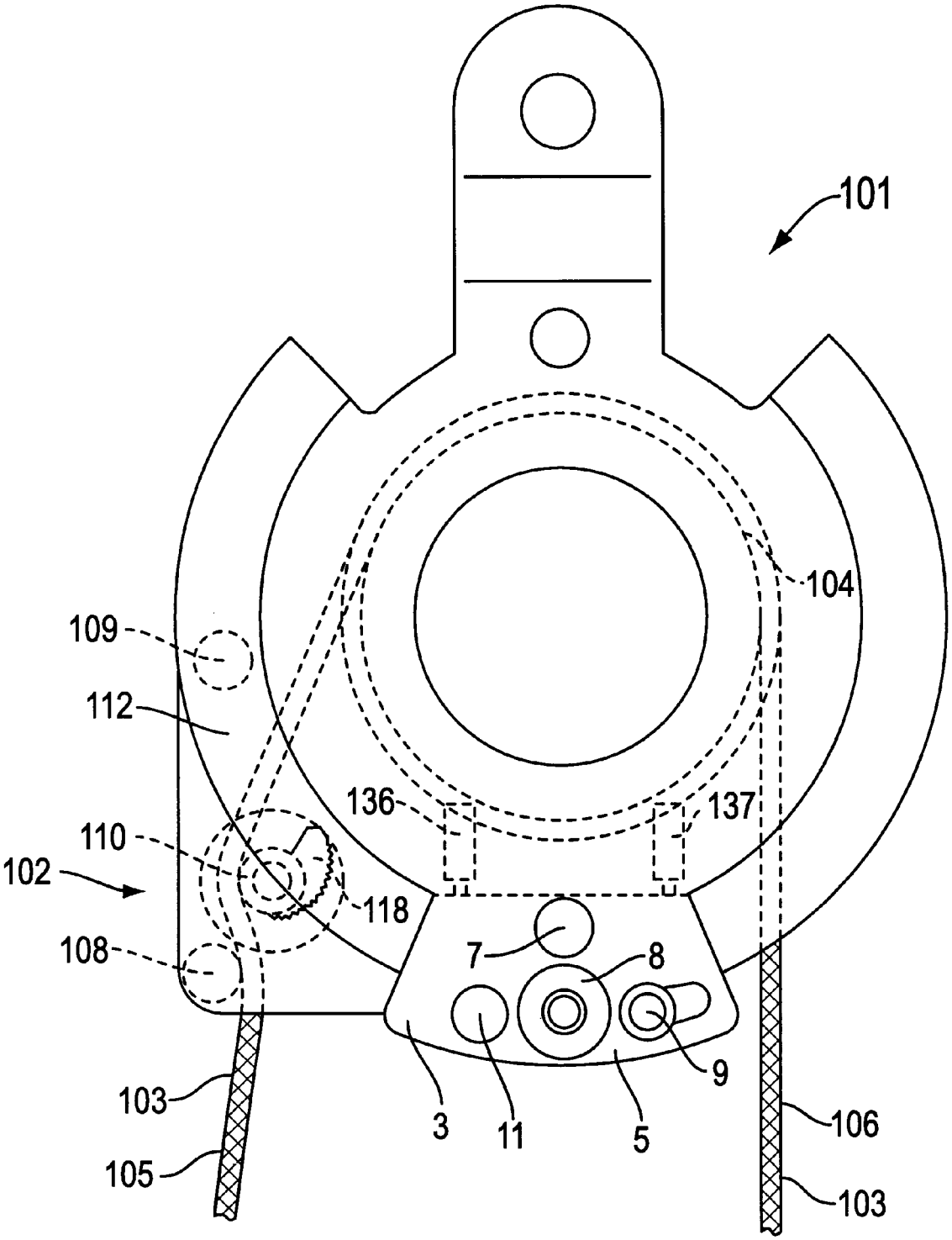
FIG. 9 shows a lateral view of a hoisting/lowering apparatus according to the invention.

FIG. 9 shows a lateral view of a hoisting/lowering apparatus 101 including a rope stop 102 according to the invention. As an example of the possible combinations of the measures according to the invention, an adaptor 3 is provided as described above with reference to FIG. 1.

The rope 103 first passes a rope stop 102 on the traction side 105, is subsequently wound 2½ times around the pulley 104, and leaves hoisting/lowering apparatus 101 on the load side 106 in the direction of the load. Only the essential hidden components of rope stop 102 are illustrated. According to the invention, reliable positioning of the rope 103 on the pulley 104 as well as the necessary lateral displacement are ensured by guiding rolls 136 and 137.

Figure 10:
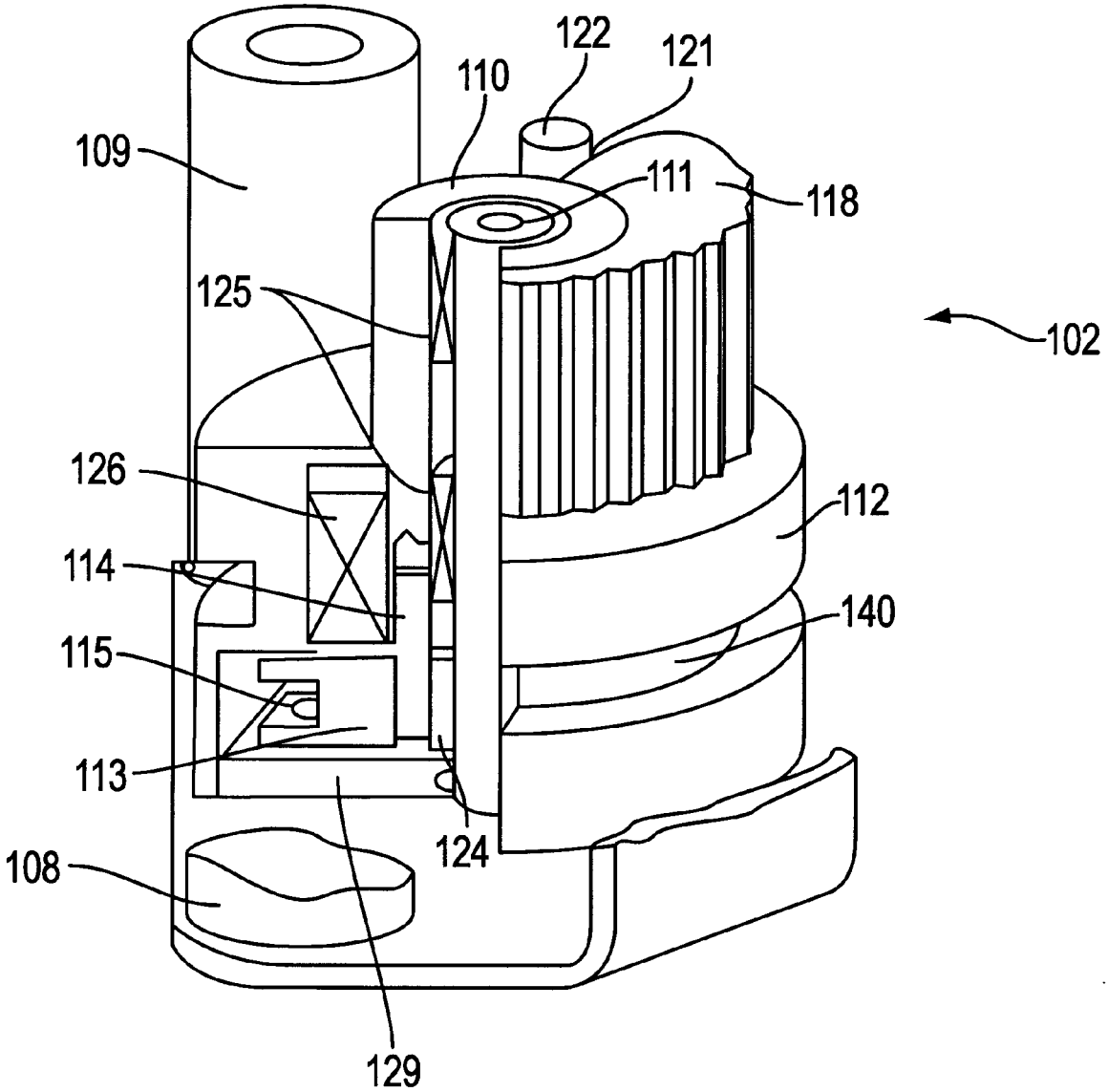
FIG. 10 shows a partially cutaway three-dimensional view of a rope stop according to the invention.
Figure 11:
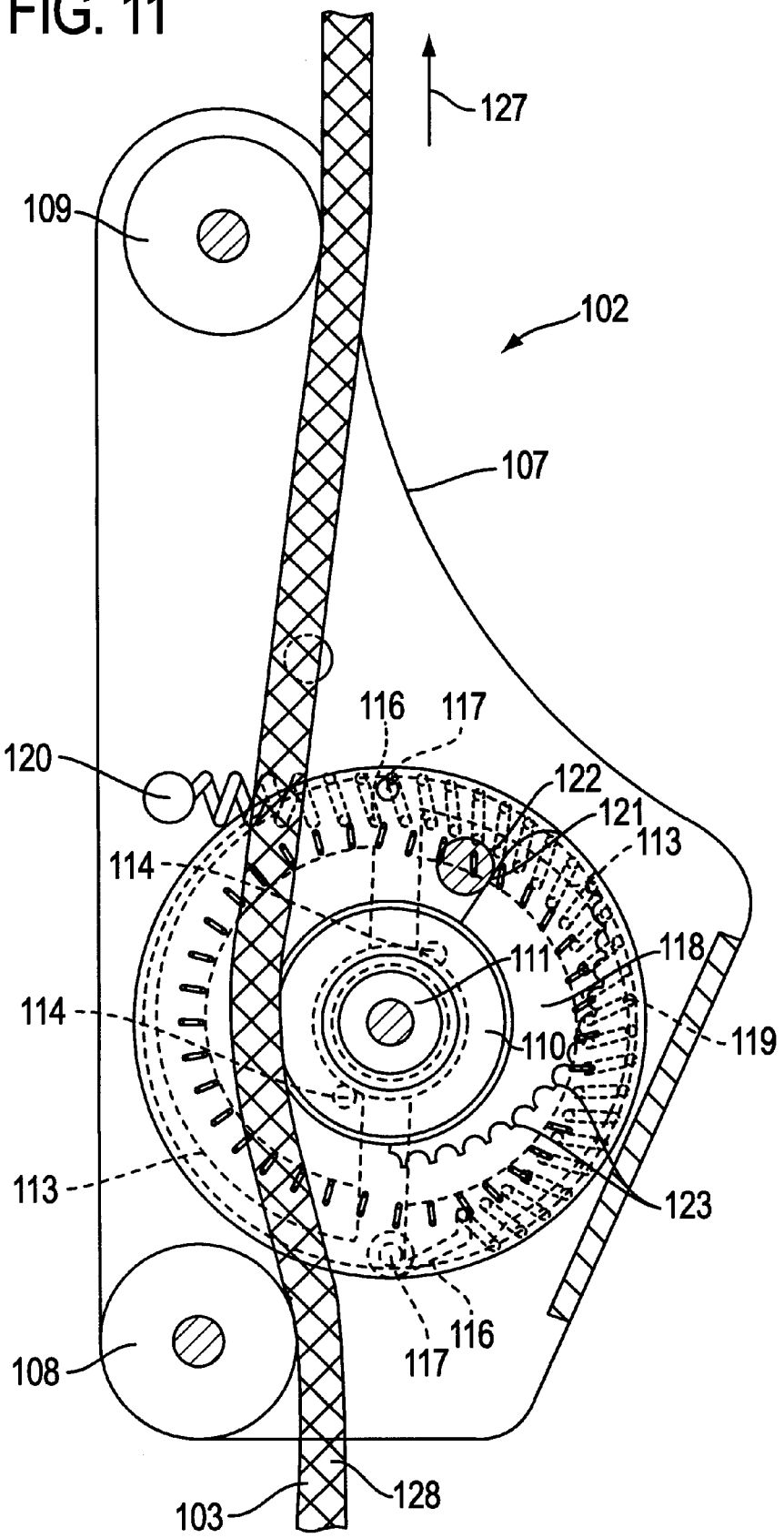
FIG. 11 shows a cross-section of the rope stop at the time when the rope speed limit is exceeded.
Figure 12:
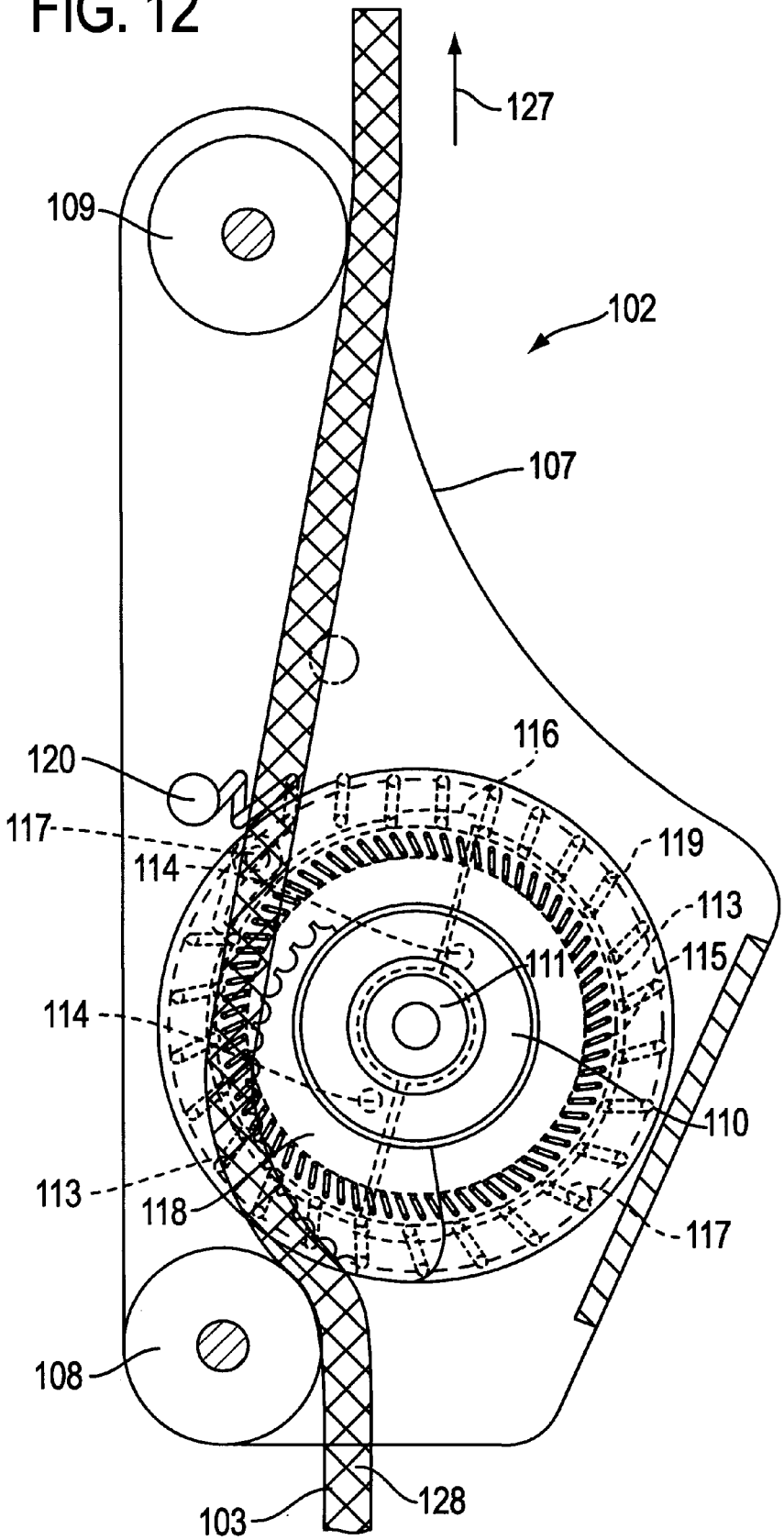
FIG. 12 shows the same cross-section as FIG. 3 with the rope stop in the activated state.
Figure 13:
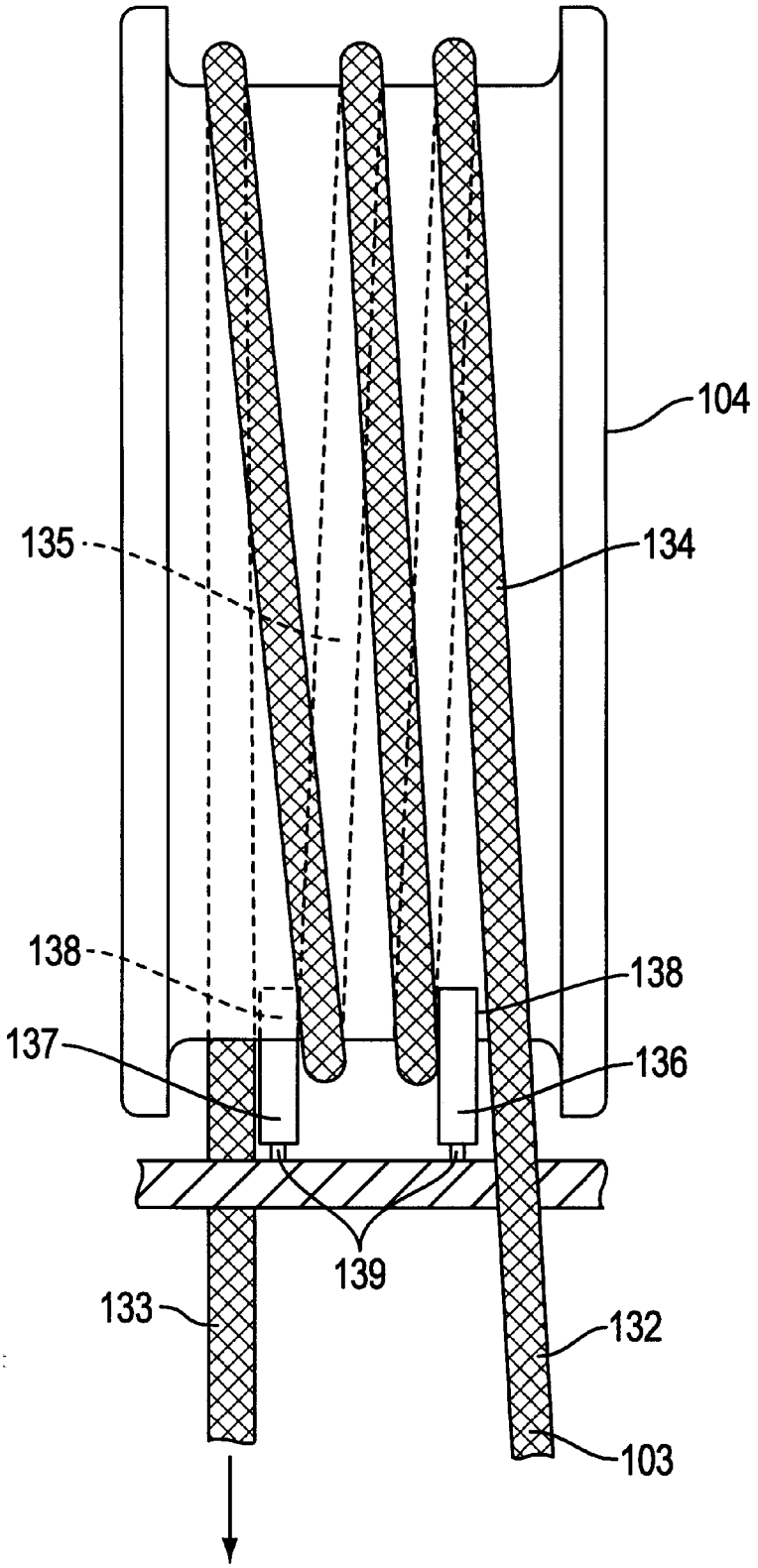
FIG. 13 schematically shows the pulley and the rope guiding only.
Figure 14:
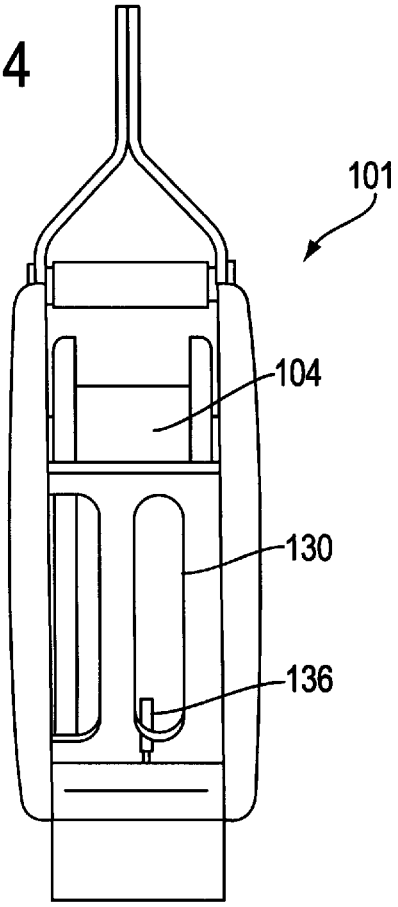
FIG. 14 shows a view from the left of the traction side of the hoisting/lowering apparatus without the rope stop.
Figure 15:
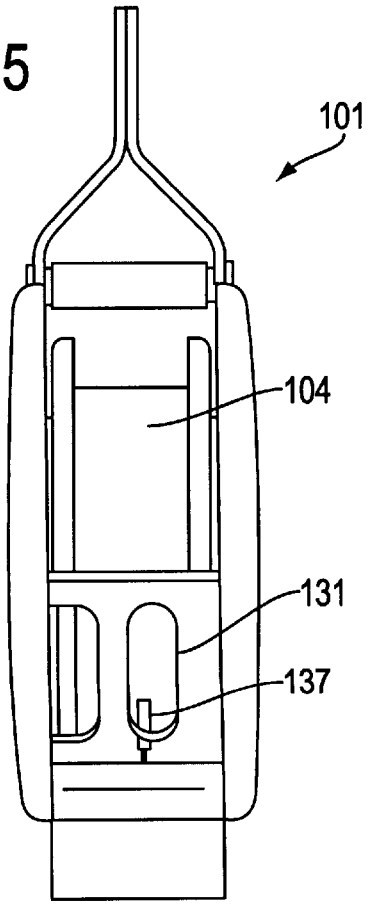
FIG. 15 shows a view of the load side of the hoisting/lowering apparatus.

The rope stop 102 is represented in detail in FIGS. 10 to 12. It comprises of a holder 107 including devices for its attachment to hoisting/lowering apparatus 1, such as holes for screws etc. Respective rotatably mounted guiding pulleys 108 and 109 are provided at the rope entrance and at its exit, respectively. The proper rope stop 110, which is also rotatably mounted, is disposed between them in such a manner that rope 103 is applied to knurled friction wheel 110 of the rope stop by the guiding pulleys 108, 109.

The friction wheel 110 is supported on shaft 111 by means of rolling bearings 125 and extends into the inside of a housing 112 in the form of a hollow shaft 124. The housing 112 is rotatable on a hollow shaft 124 by means of rolling bearings 126 as well. The side of the housing 112 facing away from the friction wheel 110 is tightly closed with respect to the shaft 111 by means of an impressed plastic disk 129.

The inside of the housing 112 holds the two wings 113. They surround the hollow shaft 124 essentially in the manner of a ring which is cut open. At one end, they are pivotably connected to the friction wheel 110 by a respective pin 114.

At the other end, a horn 116 is provided which abuts against driving pins 117 when the rope stop is activated. In order to maintain wings 113 in the freewheeling position according to FIG. 12, a thin spiral spring 115 forming a closed circle is inserted in a groove which surrounds the wings 113 on the outside. In this condition, the wings 113 rest on a hollow shaft 124.

A housing 112 includes a brake appendix 118 which extends over the friction wheel 110 and is located on the side facing away from the rope in the freewheeling position (FIG. 12). In a groove 140 surrounding housing 112, a return spring 119 is inserted which is attached to housing the 112, on one hand, and to a stud bolt 120 of the holder 107. Due to the action of the spring 119, the housing is pretensioned against the running direction 127 of the rope 103 during descending operation, i.e. the thickened rear end 21 of brake appendix 118 abuts against the stop 122 which is attached to the holder 107.

The brake appendix 118 is designed so as to narrow the gap to the lower guiding pulley in such a manner that the rope 103 is squeezed when the housing 112 is swung into the operating direction, i.e. against the action of the spring 119. For this purpose, the brake appendix is provided with a gripping, indented surface 123. In order to be adapted to different rope thicknesses, and also in view of a smooth, rope-saving action of the brake, the brake appendix in its basic form is designed as an arcuate wedge which is tapered in the operating direction. This allows the use e.g. of ropes in the range of 9 to 13 mm without an adjustment.

FIG. 11 shows an instantaneous picture of the rope stop in the condition corresponding to an immediately preceding excess of the maximum descending speed: wings 113 are swung out and in the process of engaging driving pins 117, so that the housing 112 is still in its rest position.

In FIG. 12, the rope stop has clamped and stopped rope 103: the brake appendix 118 is swung around the friction wheel 110 and squeezes the rope 103 between itself and lower guiding pulley 108. Now that the friction wheel 110 is no longer in contact with the rope 103, the wings 113 are swung back to their starting position. This state is maintained as long as the tension in the descending direction subsists. The rope stop may be activated by pulling on the traction end 123 of the rope 103.

Possible modifications of the rope stop of the invention within its scope are, among others, the use of spring elements other than the preferred ones, the replacement of pulleys 108, 109 with different, possibly fixed guiding devices, as well as different techniques for the bearings of the rotatable parts of the rope stop.

Tests have shown that the rope is significantly saved if the rope stop 102 is mounted on the traction side of hoisting/lowering apparatus 101, which is noticeable, inter alia, by substantially lesser marks of the intervention of the rope stop. One reason appears to be the fact that in this configuration, the hoisting/lowering apparatus takes up a major part of the forces which are produced when the rope is stopped by the rope stop, especially in conjunction with the softer action of the rope stop of the invention as compared to known designs. Another advantage of the described embodiment is that the rope, which is often soiled, does not enter into contact with those elements which control the activation since the proper centrifugal clutch (wings 113, drivers 117 and spring 115) is enclosed in the sealed housing 112 whereby it is largely isolated from the surroundings.

It has been found that the rope travel on the pulley 104 as well as an optimized surface of the latter is significant for a reduced wear of the rope in normal operation. In the schematical illustration of the rope travel of FIG. 13, the rope 103 passes 2½ turns around pulley 104. By 2½ turns, a reduction of the retaining force of about 15% is obtained without further measures, while a retaining force of about 30% results in the case of 1½ turns under otherwise identical conditions.

In the hauling/lowering operation, the rope sections on the pulley 104 have to move from the place of their first contact with the pulley to its exit. However, the substantially known, loop-shaped rope guidings on the entrance side (FIG. 14: reference numeral 130) and on the exit side (FIG. 15: reference numeral 131), whose function is naturally reversed when switching from the lowering to the hauling operation, did not safely prevent a superposition of the entering rope 132 resp. 133 upon the respective first winding 134 resp. 135, depending on the running direction. Such a superposition, as well as an irregular displacement of the rope on pulley 104, may result in increased wear of the rope 103, besides the consequent malfunctions which are especially undesirable especially in rescue operations.

It has been found that a regular, troublefree guidance of the rope with reduced wear can be obtained by additional guiding rolls 136, 137 acting as positioners for the entering rope 103. These guiding rolls nay comprise Teflon caps 138 which are rotatable on pins 139. The rolls 136, 137 might also be located directly under the pulley 104, but the illustrated position where they are located near the points of the first contact of outgoing rope ends 132, 133 on the pulley has been found to be particularly effective.

In this manner, the guiding rolls 136, 137 prevent the following winding 134, 135 from ending up under the free rope ends 132 resp. 133.

Instead of Teflon™ (polytetrafluorethylene), other materials which generally combine low coefficients of friction with high stability are possible for the caps 138. It is also possible that the rotatability of caps and rolls 136, 137 is omitted.

I claim:

1. A hoisting and lowering apparatus for raising or lowering loads, said apparatus including a housing having an adapter portion for accepting a self-locking coupling; said self-locking coupling removably engaging an accessory with the apparatus for removably attaching accessories to the apparatus; and a safety release connected to said adapter portion for releasing the self-locking coupling, said safety release preventing unintentional release of the coupling from the apparatus wherein said adapter portion includes at least one slot-shaped recess for recessing said self-locking coupling, said at least one recess being traversed by first and second retaining elements, said retaining elements forming a narrowing in said recess, said recess widening behind said retaining elements in such a manner as to engage said self-locking coupling.

2. The hoisting and lowering apparatus according to claim 1, wherein at least two recesses are provided, each of which is traversed by each of said first and second retaining elements.

3. The hoisting and lowering apparatus according to claim 1, wherein at least the second retaining element is displaceable whereby the narrowing in said at least one recess is enlargable by moving said second retaining element from a coupling retaining position to a coupling releasing position.

4. The hoisting and lowering apparatus according to claim 3 further comprising an elastic spring element for biasing said second retaining element from movement out of said retaining position.

5. The hoisting and lowering apparatus according to claim 1 wherein said safety release includes a third removable retaining element which traverses said recess, and a locking device capable of being activated against a spring bias for engaging the adapter portion, to thereby prevent self-acting detachment of said third retaining element from the adapter portion, said safety release comprising a release mechanism for releasing said locking device.

6. The hoisting and lowering apparatus according to claim 1 wherein said safety release includes a locking device for automatically disabling movement of said second retaining element from its retaining position by engagement with the adapter, and wherein said safety release is operable to release said locking device.

7. The hoisting and lowering apparatus according to claim 5 wherein at least one of the first, second and third retaining elements are substantially pin-shaped and pass through aligned holes which traverse the recesses.

8. The hoisting and lowering apparatus according to claim 1, wherein said accessory comprises at lease one plate-shaped coupling member, adapted to be inserted in said at least one recess respectively, having a neck portion and an enlarged tongue portion extending beyond said neck portion, said portion having a width less than or equal in size to the narrowing between the first and the second retaining elements in their retaining position to thereby permit insertion of said coupling member into an associated recess whereby said neck portion is located in said narrowing and wherein said enlarged tongue portion is engaged rearward of said first and second retaining elements.

9. The hoisting and lowering apparatus according to claim 8 wherein said accessory is provided with at least two plate-shaped coupling members which are substantially parallel to each other, each having an aligned neck portion.

10. The hoisting and lowering apparatus according to claim 8, wherein each of said enlarged tongue portions has a cam shaped corner for effecting a movement of the second retaining element out of its retaining position by the introduction of the plate-shaped coupling member into said at least one recess.

11. The hoisting and lowering apparatus according to claim 10, wherein said cam shaped corner is bevel shaped.

12. The hoisting and lowering apparatus according to claim 10, wherein said cam shaped corner is rounded.

13. The hoisting and lowering apparatus according to claim 10, wherein said cam shaped corner has a combination of beveled and rounded edges.

* * * * *